US009277303B2

(12) United States Patent
Busenitz

(10) Patent No.: US 9,277,303 B2
(45) Date of Patent: Mar. 1, 2016

(54) TREATMENT FOR LOUDSPEAKER SUSPENSION ELEMENT FABRIC

(71) Applicant: Bose Corporation, Framingham, MA (US)

(72) Inventor: John Busenitz, Clinton, MA (US)

(73) Assignee: Bose Corporation, Framingham, MA (US)

( * ) Notice: Subject to any disclaimer, the term of this patent is extended or adjusted under 35 U.S.C. 154(b) by 157 days.

(21) Appl. No.: 14/161,008

(22) Filed: Jan. 22, 2014

(65) Prior Publication Data

US 2015/0208148 A1 Jul. 23, 2015

(51) Int. Cl.

| | |
|---|---|
| ***H04R 9/06*** | (2006.01) |
| ***H04R 1/00*** | (2006.01) |
| ***H04R 7/16*** | (2006.01) |
| ***H04R 9/04*** | (2006.01) |
| ***H04R 31/00*** | (2006.01) |
| *H04R 11/02* | (2006.01) |

(52) U.S. Cl.

CPC .. *H04R 1/00* (2013.01); *H04R 7/16* (2013.01); *H04R 9/043* (2013.01); *H04R 31/003* (2013.01); *H04R 9/06* (2013.01)

(58) Field of Classification Search

CPC ..... H04R 1/06; H04R 1/021; H04R 1/22; H04R 7/00; H04R 7/12; H04R 7/16; H04R 7/18; H04R 7/20; H04R 7/122; H04R 9/02; H04R 9/06; H04R 9/041; H04R 9/043; H04R 9/045; H04R 2307/207

USPC ..... 381/398, 403, 404; 181/166, 171, 172

See application file for complete search history.

(56) References Cited

U.S. PATENT DOCUMENTS

| | | | | |
|---|---|---|---|---|
| 4,239,944 | A | 12/1980 | Obara et al. | |
| 5,619,019 | A * | 4/1997 | Yoshimura | H04R 7/26 181/174 |
| 6,039,145 | A | 3/2000 | Ogura et al. | |
| 7,397,927 | B2 | 7/2008 | Pircaro et al. | |
| 8,139,812 | B2 * | 3/2012 | Basnet | H04R 7/20 181/171 |
| 2003/0188919 | A1 | 10/2003 | Suzuki et al. | |
| 2004/0026164 | A1 | 2/2004 | Takahashi et al. | |

FOREIGN PATENT DOCUMENTS

| | | | |
|---|---|---|---|
| EP | 1411747 | A2 | 4/2004 |
| GB | 1442468 | A | 7/1976 |

(Continued)

OTHER PUBLICATIONS

Christie, Cary, Epsilon Project: A View into Advanced Loudspeaker Design and Technology, 1994, Infinity Systems, Inc., Chatsworth, CA; 24 pages.

Bekampiene, et al., The Effect of Pre-Tension on Deformation Behaviour of Natural Fabric Reinforced Composite, Materials Science (Medziagotyra), Jan. 8, 2011, pp. 56-61, vol. 17, No. 1.

(Continued)

*Primary Examiner* — Brian Ensey

(74) *Attorney, Agent, or Firm* — Schmeiser, Olsen & Watts LLP

(57) ABSTRACT

A loudspeaker suspension comprises a body formed of a weave fabric. The body has an outer region and a central region. A warp region extends substantially from the central region to the outer region. A weft region orthogonal to the warp region extends substantially from the central region to the outer region. A region is between the warp region and weft region. At least a portion of the warp and weft regions of the weave fabric includes a stiffness-reducing treatment.

38 Claims, 9 Drawing Sheets

(56) References Cited

FOREIGN PATENT DOCUMENTS

| | | | |
|---|---|---|---|
| JP | 2995454 | B2 | 12/1999 |
| JP | 2006352276 | A | 12/2006 |
| WO | 2013141373 | A1 | 9/2013 |

OTHER PUBLICATIONS

International Search Report and Written Opinion in related International Patent Application No. PCT/US15/11904, mailed on Mar. 23, 2015; 16 pages.

* cited by examiner

TREATMENT FOR LOUDSPEAKER SUSPENSION ELEMENT FABRIC

BACKGROUND

The present disclosure relates generally to electro-acoustic transducers, including loudspeakers, and more specifically, to the treatment of suspension element fabrics for transducers.

BRIEF SUMMARY

Disclosed is a loudspeaker suspension structure that is treated to reduce the effects of non-axisymmetric stiffness.

In one aspect, an apparatus includes a loudspeaker suspension, comprising a body formed of a weave fabric, the body having an outer region and a central region; a warp region extending substantially from the central region to the outer region; a weft region orthogonal to the warp region and extending substantially from the central region to the outer region; and a region between the warp region and the weft region, wherein at least a portion of the warp and weft regions of the weave fabric includes a stiffness-reducing treatment.

The following are examples within the scope of this aspect.

At least a portion of the region between the warp and weft regions includes the stiffness-reducing treatment. The warp and weft regions have a disproportionate application of the stiffness-reducing treatment as compared to the region between the warp and weft regions.

The stiffness-reducing treatment reduces the effects of non-axisymmetric stiffness on the weave fabric of the body.

The stiffness-reducing treatment substantially equalizes a stress concentration between the warp and weft regions and the region between the warp and weft regions when a load is applied to the body.

The stiffness-reducing treatment is applied to the warp and weft regions so that the stiffness of the warp and weft regions is substantially the same as the stiffness of the region between the warp and weft regions.

The loudspeaker suspension can comprise two warp regions and two weft regions, wherein the warp and weft regions are presented in alternation.

The two warp and two weft regions include the stiffness-reducing treatment, and the regions between the warp and weft regions do not include the stiffness-reducing treatment or include a less stiffness-reducing treatment than the two warp and weft regions.

The stiffness-reducing treatment can comprise rubber.

The portion of the warp and weft regions receiving the stiffness-reducing treatment can be generally pie-shaped.

The stiffness-reducing treatment can extend substantially from the central region to the outer region of the body within the warp and weft regions.

The thickness of the stiffness-reducing treatment varies across the warp and weft regions.

A region applied with the stiffness-reducing treatment can include a four-fold rotational symmetry shape.

A region applied with the stiffness-reducing treatment can include a dihedral symmetry shape.

The loudspeaker suspension can further comprise an opening at the central region of the body for receiving a voice coil.

The central region can include at least a portion of the weave fabric, wherein a voice coil is coupled to the portion of the weave fabric at the central region.

In another aspect, an apparatus includes an electroacoustic transducer, comprising: a basket; a voice coil; and a suspension element having an outer region coupled to the basket, and an inner region coupled to the voice coil. The suspension element has a warp region, a weft region orthogonal to the warp region, and a region between the warp region and the weft region, at least a portion of the warp and weft regions having a stiffness-reducing treatment, such that the warp and weft regions have a stiffness that is substantially the same as the a stiffness of the regions between the warp and weft regions.

The following are examples within the scope of this aspect.

The suspension element can be a spider.

The suspension element can be a surround.

At least a portion of the region between the warp and weft regions includes the stiffness-reducing treatment, and the warp and weft regions have a disproportionate application of the stiffness-reducing treatment as compared to the at least one region between the warp and weft regions.

The stiffness-reducing treatment reduces the effects of non-axisymmetric stiffness on the weave fabric of the suspension element.

The stiffness-reducing treatment substantially equalizes a stress concentration between the warp and weft regions and the at least one region between the warp and weft regions when a load is applied to the suspension element.

The stiffness-reducing treatment is applied to the warp and weft regions so that the stiffness of the warp and weft regions is substantially the same as the stiffness of the at least one region between the warp and weft regions.

The stiffness-reducing treatment can comprise rubber.

The portion of the warp and weft regions receiving the stiffness-reducing treatment can be generally pie-shaped.

The stiffness-reducing treatment can extend substantially from the inner region to the outer region of the suspension element within the warp and weft regions.

The thickness of the stiffness-reducing treatment can vary across the warp and weft regions.

A region applied with the stiffness-reducing treatment can include a four-fold rotational symmetry shape.

A region applied with the stiffness-reducing treatment can include a dihedral symmetry shape.

In another aspect, a method for forming a suspension element for an acoustic driver, comprises forming a body of a weave fabric, the body having an outer region and a central region; and selectively applying a stiffness-reducing treatment to at least one of a warp region and a weft region orthogonal to the warp region.

The following are examples within the scope of this aspect.

Prior to the application of the stiffness-reducing treatment, the weave fabric is impregnated with a resin.

A mask can be positioned over the body, the mask including openings aligned with, and exposing, the at least one warp and weft region to be applied with the stiffness-reducing treatment.

The method can further comprise selectively applying the stiffness-reducing treatment to at least one region between the warp and weft regions. The mask can include multiple masks, which are positioned over the body to apply different amounts of the stiffness-reducing treatment to the warp and weft regions and the at least one region between the warp and weft regions, respectively.

A stress at the at least one of the warp and weft region can be compared with a stress at a region between the warp and weft regions. An amount of the stiffness-reducing treatment applied to the at least one warp and weft region can be adjusted until the stresses at the at least one warp and weft region and the region between the warp and weft regions, respectively, are substantially the same or within a predetermined threshold relative to each other.

At least a portion of a region between the warp and weft regions includes the stiffness-reducing treatment. The at least one warp and weft region has a disproportionate application of the stiffness-reducing treatment as compared to the region between the warp and weft regions.

The effects of non-axisymmetric stiffness on the weave fabric of the body can be reduced in response to a selective application of the stiffness-reducing treatment on the body.

The stiffness-reducing treatment substantially equalizes a stress concentration between the at least one warp and weft region and at least one region between the warp and weft regions when a load is applied to the body.

The stiffness-reducing treatment is applied to the at least one warp and weft region so that the stiffness of the at least one warp and weft region is substantially the same as the stiffness of at least one region between the warp and weft regions.

The thickness of the stiffness-reducing treatment varies across the at least one warp and weft region.

The loudspeaker suspension can further comprise an opening at the central region of the body for receiving a voice coil.

The central region includes at least a portion of the weave fabric, wherein a voice coil is coupled to the portion of the weave fabric at the central region.

In another aspect, an apparatus includes a loudspeaker suspension, comprising means for forming a body of a weave fabric, the body having an outer region and an opening in a central region of the body; and means for selectively applying a stiffness-reducing treatment to at least one of a warp region and a weft region orthogonal to the warp region.

Other aspects and features and combinations of them can be expressed as methods, apparatus, systems, program products, means for performing functions, and in other ways.

BRIEF DESCRIPTION

The above and further features and advantages may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Figure 1A:
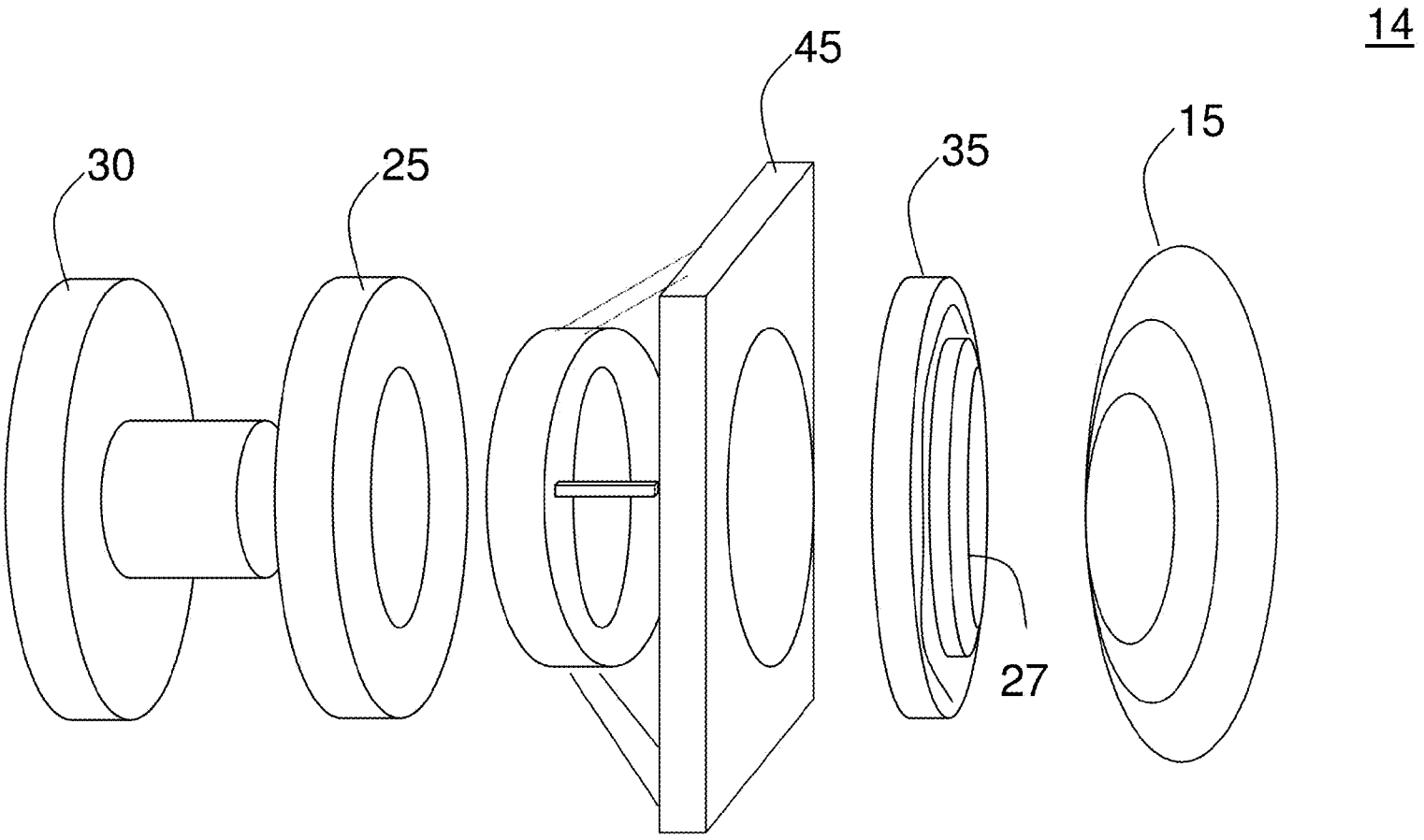
FIG. 1A is an exploded isometric view of a loudspeaker.
Figures 1B, 1C:
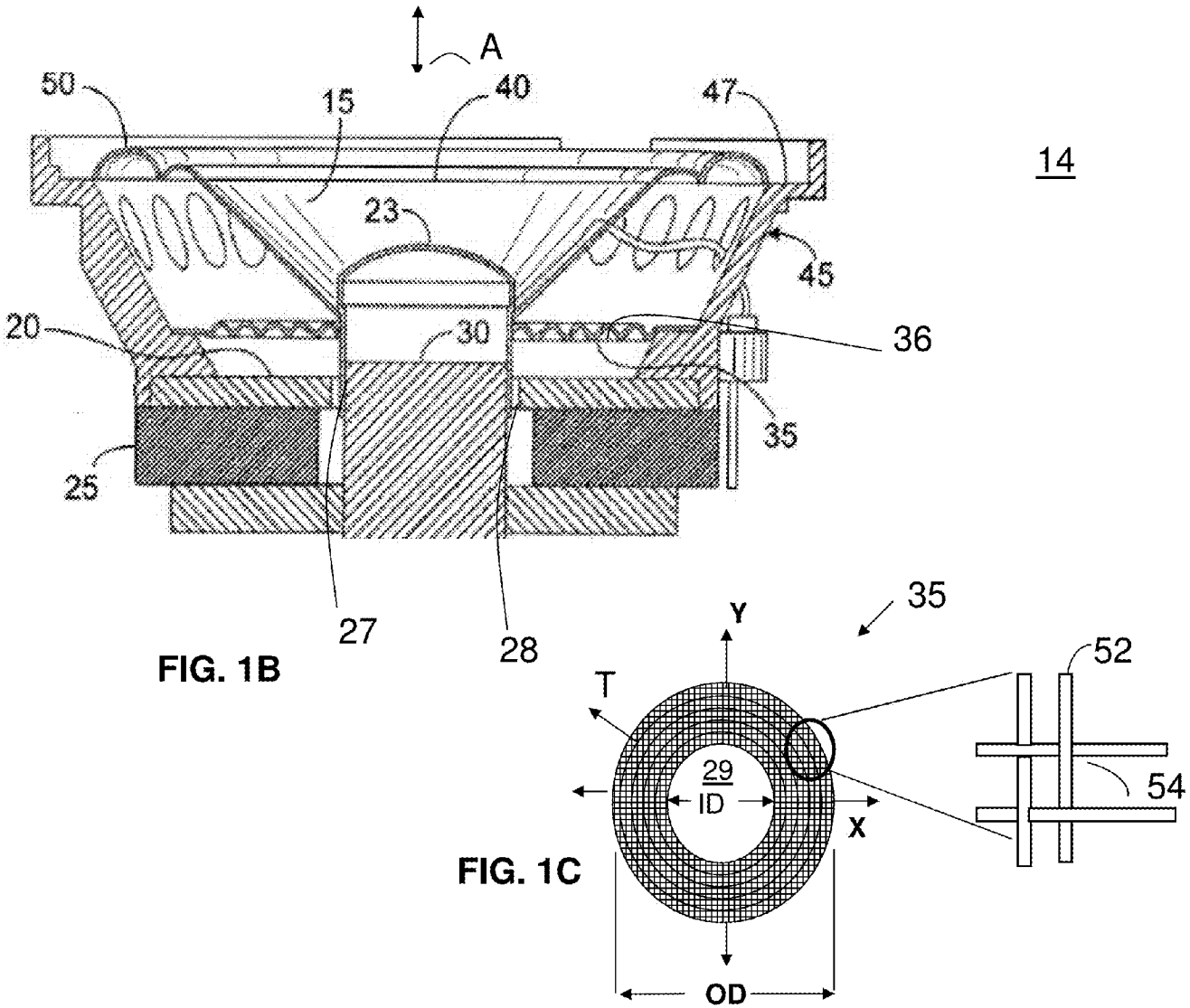
FIG. 1B is an assembled cross-sectional front view of the loudspeaker of FIG. 1A.
FIG. 1C is a plan view of a spider positioned in the loudspeaker of FIGS. 1A and 1B.

FIG. 1A is an exploded isometric view of an acoustic device, such as a loudspeaker 14. FIG. 1B is an assembled cross-sectional front view of the loudspeaker 14 of FIG. 1A. The loudspeaker may reproduce a wide range of frequencies, and may include subwoofers, woofers, mid-range speakers, tweeters, or a combination thereof.

The loudspeaker 14 includes a diaphragm 15, sometimes referred to as a cone, connected to a voice coil 27. The loudspeaker 14 can include a dust cap 23 attached to an opposite side of the cone 15 as the voice coil 27 for preventing dust particles from accumulating in an annular gap 28 between a pole plate structure 20 on a permanent magnet 25 and a pole piece 30. The voice coil 27 interacts with a magnetic circuit formed from the permanent magnet 25 and the pole plate structure/pole piece 20, 30. When the voice coil 27 is driven by an audio signal, the cone 15 vibrates axially to produce sound.

Loudspeakers typically include one or more suspension structures such as a spider (also referred to as a damper) and a surround. For example, as shown in FIG. 1B, an outer edge 40 of the cone 15 is attached to a rigid frame 45, also referred to as a basket, along an annular mounting flange 47 by a first suspension element 50, or surround. The voice coil 27 and/or apex of the cone 15 may be attached to another section of the rigid basket 45 or frame by a second suspension element 35, or spider. In particular, the spider 35 is coupled between the bobbin of the voice coil 27 and the frame 45, and is constructed and arranged to constrain the voice coil 27 to move axially through the annular gap 28. The suspension elements 35, 50 preferably restrict the movement of the cone 15 along an axis of the cone 15 indicated by axis A in FIG. 1B. Single or multiple surrounds and/or spiders may be used in various transducer configurations. The suspension elements 35, 50 may be formed of cloth or similar material. Cloth suspensions generally have pseudo-orthotropic properties, more specifically, an elastic modulus or related deformation properties, due to the weave construction of cloth suspensions, as will be further explained.

The surround 50 may be made from a flexible material, including but not limited to fabric, rubber, foam, elastomer, or polyurethane (PU) plastic, such as thermoplastic polyurethane (TPU). The surround 50 may be impregnated with a stiffening resin, allowing the cone 15 to vibrate while providing a restoring force to aid in returning the cone to an at-rest position when the voice coil 27 is not being driven. The surround 50 may be a circular half roll having a single convolution, but the surround 50 could be, without limitation, configured as a full roll, an inverted half roll, (i.e., flipped over 180 degrees), or a roll having multiple convolutions. A convolution as used herein comprises one cycle of a possibly repeating structure, where the structure typically comprises concatenated sections of arcs. The arcs are generally circular, but can have any curvature. The surround 50 could be circular or non-circular in shape. For example, without limitation, the surround 50 could be an ellipse, toroid, square, rectangle, oblong, racetrack, or other non-circular shapes.

The spider 35 may be formed of similar materials as the surround 50. In some examples, the spider 35 may be formed of a woven or non-woven fabric having elastic properties and comprising meshed warp and weft fibers 52, 54 (as shown in FIG. 1C) extending along orthogonal axes, respectively. The fibers 52, 54 can be formed of cotton, polyester, nylon, cellulose, polymers, aramids such as Nomex®, fiber composites such as elastomers, and/or natural and/or synthetic materials having the same, similar, or related properties, and/or a combination thereof.

As shown in FIGS. 1B and 1C, the spider 35 can be in a shape of a corrugated disk or the like, or otherwise include one or more convolutions 36 that permit the voice coil 27 to move axially, i.e., along the axis A. The spider 35 can have but is not limited to a circular shape, having for example, an inner diameter (ID) of an opening 29 at a central region of the spider 35 for receiving the voice coil 27 and an outer diameter (OD) for positioning the spider 35 in the basket 45. Other curved shapes can equally apply, including but not limited to an ellipse, toroid, square, rectangle, oblong, racetrack, or other non-circular shapes, or a combination thereof.

In a suspension element made of woven fabric, during operation of the loudspeaker, regions of the suspension element along the warp and weft of the fabric receive varying and unequal forces applied thereto as compared to other regions of the suspension element. When the meshed fibers 52, 54 of the spider 35 are stretched, for example, during operation of a loudspeaker when the voice coil 27 and spider 35 move back and forth along the axis A, the pseudo-orthotropic material properties related to the weave construction may cause the regions of the spider 35 along the warp (X direction) and weft (Y direction) to experience shape distortion, buckling, or other related undesirable effects on the spider 35 due to the non-axisymmetric stiffness distribution, which in turn can impact sound reproduction integrity.

For example, referring to FIG. 1C, when a stretching force is applied, the deformation of the spider 35 in the X direction may be equal to the elastic deformation of the spider 35 in the Y direction. However, different stretching forces may be applied at directions between the X and Y directions, for example, at a bias direction T (about 45 degrees), resulting in an unbalanced deformation of the spider 35, and therefore impacting the sound quality of the speaker. Also, a non-axisymmetric elastic modulus distribution at regions proximal the opening 29 of the spider 35 may be greater than at corrugated regions proximal the outer perimeter of the spider 35, indicative of irregular strength distribution, which can further impact the sound quality produced by the speaker.

Figure 2:
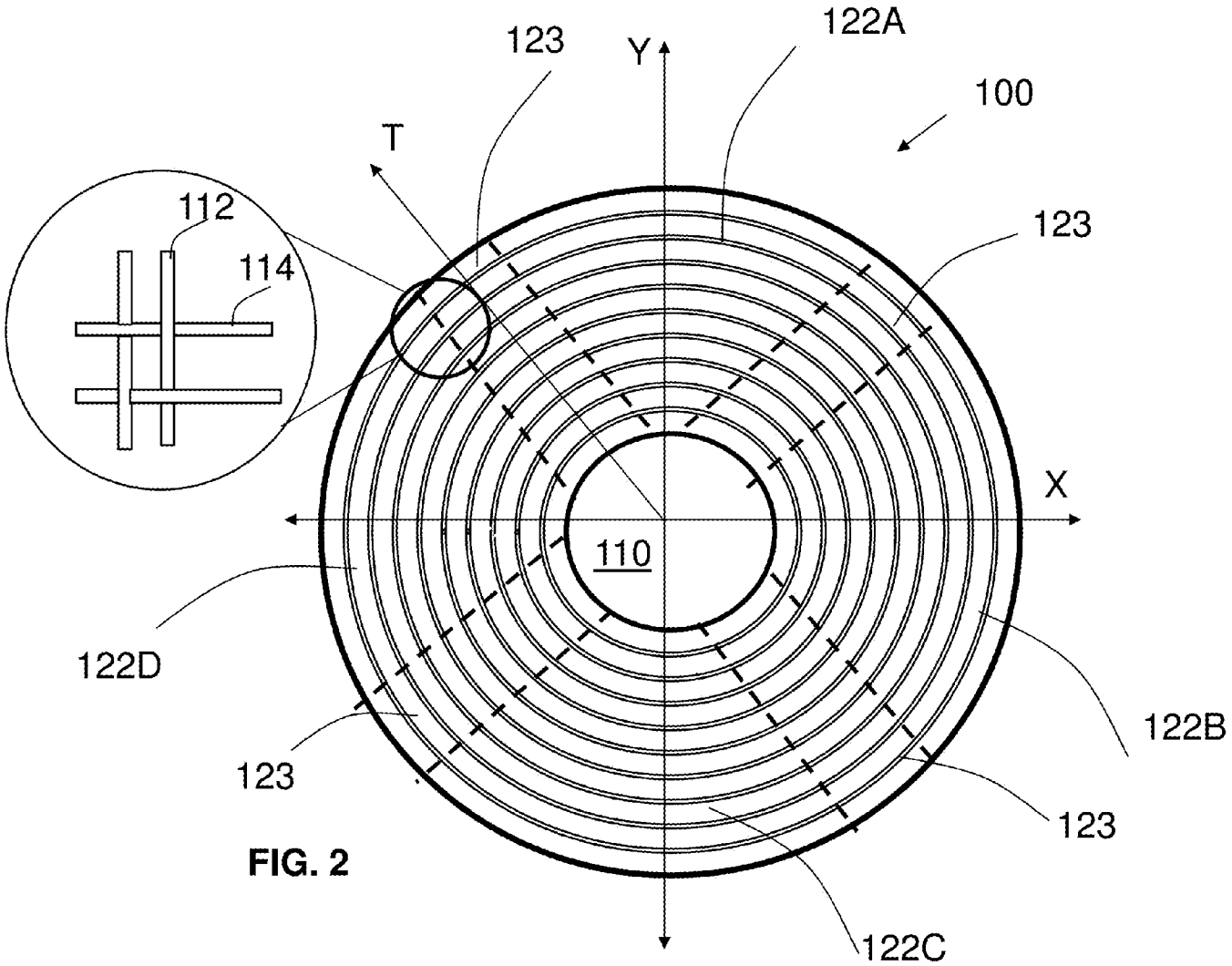
FIG. 2 illustrates an example of a front view of a suspension element prior to a treatment.

FIG. 2 illustrates an example of a front view of a spider suspension element 100. The spider 100 can be constructed and arranged in a similar or same manner as the spider 35 described with reference to FIGS. 1A-1C. For example, the spider 100 may be formed to include one or more concentric corrugations, or convolutions. In one embodiment, as shown in FIG. 2, the spider 100 includes a mount hole 110 having an ID for receiving the voice coil or the like, and permits the spider 35 to be positioned in a speaker basket or the like. In another embodiment, the spider 100 does not include a mount hole 110, but instead includes a central region at which a dust cap or the like, for example, similar to dust cap 23 shown at FIG. 1B, that can be integrated or otherwise coupled at the central region of the spider 100. Here, a voice coil can be coupled, for example, glued, to the spider 100 by a butt joint or the like instead of a thru-joint or the like typically provided in configurations where the spider 100 has a mount hole 110. The spider 100 can have a circular, and/or other geometry, including but not limited to an ellipse, toroid, square, rectangle, oblong, racetrack, or other non-circular shapes, or a combination thereof.

The spider 100 may be constructed and arranged as a fiber mesh comprising a weave structure known to those of ordinary skill in the art. Examples include but are not limited to a plain weave, a honeycomb weave, a triaxial weave, twill, or a combination thereof. As shown in FIG. 2, the weave can comprise a mesh of biaxial weave with filaments, fibers, threads, or related elements being arranged in two orthogonal or near orthogonal directions, for example, vertical and horizontal directions, where a plurality of warp filaments, fibers, or the like, or warps 112, and weft filaments, fibers, or the likes, or wefts 114, which are interleaved, are positioned about the mount hole 110 at which a voice coil can be positioned. In the example shown in FIG. 2, the warp fibers 112 are substantially aligned with the Y direction and the weft fibers 114 are substantially aligned with the X direction.

The materials forming the warp fibers 112 and weft fibers 114 can comprise the same, similar, or related materials, for example, cotton, polyester, nylon, cellulose, polymers, aramids such as Nomex®, fiber composites such as elastomers, and/or materials having the same, similar, or related properties, and/or a combination thereof. Accordingly, the properties of the warp fibers 112 and weft fibers 114 may be the same or similar. However, the interleaving of the warp fibers 112 and weft fibers 114 can be such that a strength of the warp fibers 112 stretched by a force, e.g., a load, in the Y direction is weaker than that of the weft fibers 114 stretched by a force in the X direction. In one example, the warp strength can be (but is not limited to) about 80% of the strength of the weft, due to a non-axisymmetric stiffness with respect to the various regions of the spider 35. The weave fibers do not extend along the T direction, for example, at 45 degrees relative to the X direction or Y direction. Therefore, regions 123 along the T direction are substantially weaker than regions 122A-122D (generally, 122) along the X or Y direction. Accordingly, left untreated, the warp and weft regions along the Y or X direction, respectively, may have an undesirably high stiffness as compared to other regions.

To address the foregoing issues with respect to the varying stiffnesses of the warp and weft regions 122A-122D and regions 123 therebetween of a suspension element such as a spider 100, a treatment is selectively provided to the suspension element fabric to reduce the stiffness of the warp and weft regions 122A-122D and thereby reduce the effects of non-axisymmetric stiffness with respect to the spider fabric. In addition, the selective application of the stiffness-reducing treatment reduces the stress concentration that may occur at the warp and weft regions 122A-122D, in particular, at regions about the opening 110. The treatment is selectively applied to regions of the suspension element material in varying amounts according to the material, geometry, use/application of the element, and so on. The treatment can be sprayed onto the material, pad-printed, or otherwise applied to the material according to one or more different techniques. The treatment can be applied to lower the resulting difference in contribution to axial stiffness seen traversing about the ID of the opening 110. Accordingly, a relatively equal distribution of stiffness and stress concentration between the various regions of the spider can be achieved regardless of the direction of a force applied to the spider. The stress concentration and/or stiffness with respect to the regions aligned with the warp and weft can be at a predetermined threshold as compared to other regions.

Figure 3:
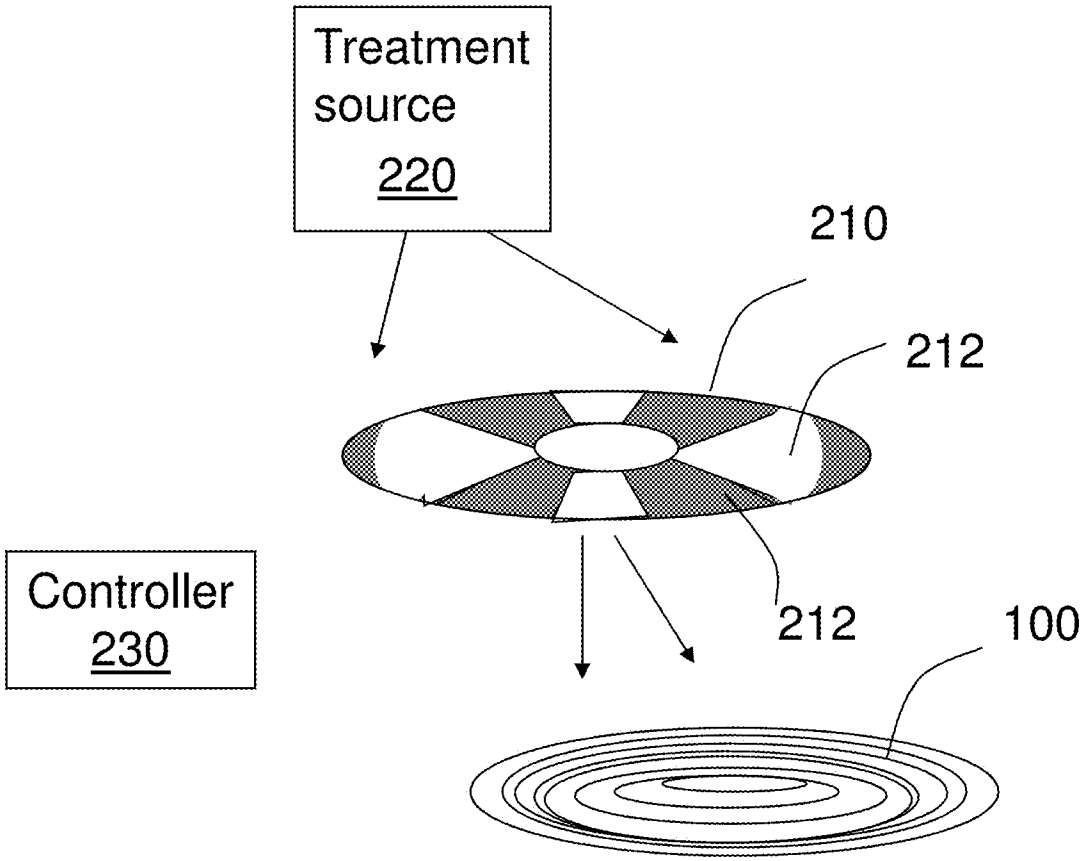
FIG. 3 is a diagram illustrating an exemplary process for treating a suspension element.

FIG. 3 is a diagram illustrating a process for treating a suspension element. As described in FIG. 3, the process can be applied to a spider, such as the spider 100 of FIG. 2. In other examples, the process can be applied to a surround or related suspension elements. System elements for treating a suspension element can include but not be limited to at least a mask 210 or jig, a treatment source 220, and a controller 230.

Prior to treatment by the treatment source 220, the spider fabric can be impregnated with a stiffening agent such as a resin, for example, a phenolic resin solution or related treatment that is compatible with a stiffness-reducing treatment referred to herein. The spider fabric can be pressure and/or heat treated. The woven fabric, for example, cotton or the like, provides strength and fracture toughness to the spider 100 and the phenolic resin provides enough stiffness to maintain the spider geometry. In addition, as will be further described, the phenolic resin may aid in bonding the treatment to the spider.

In one example, to selectively apply treatment to the fabric of the spider 100 before or after formation of the spider 100, the mask 210, or jig, can be positioned over a surface of the spider 100. The mask 210 can be formed of a rigid material such as sheet-steel or the like. The mask 210 includes openings 212 that can be aligned with, and expose, the warp and weft regions of the spider 100 to the treatment source 220. In other words, the openings 212 of the mask 210 expose warp and weft regions 122A-122D (shown in FIG. 2). The masked areas 213 of the spider include regions 123 of the spider 100 between the warp and weft regions 122 (also shown in FIG. 2), for example, regions 123 extending at approximately a 45 degree angle relative to the warp and weft regions 122 from a mount hole of the spider 100 to the periphery of the spider 100. The mask 210 can be configured to include openings for the other regions 123 and permit less treatment or no treatment to be applied to these regions as compared to the warp/weft regions 122.

The treatment source 220 can selectively apply a treatment to the unmasked warp and weft regions of the spider. The treatment can include a rubber-based material, for example, styrene-butadiene rubber (SBR), and/or other softeners. The treatment selection can depend on, but not be limited to, the spider fabric material, the resin used to coat the spider, and/or the type of weave. The treatment can impregnate the warp and weft regions 122A-122D, and interact with the phenolic resin or the like at the warp and weft regions 122A-122D to reduce stiffness at these regions relative to the masked regions 123, for example, shown in FIG. 4. In some examples, the resulting stiffness at the warp and weft regions 122A-122D is substantially the same as, or may be within an acceptable threshold of, the stiffness at the masked regions 123. The treatment may also reduce a stress level of the warp and weft regions 122A-122D until it is substantially equal to or within an acceptable threshold of the stress level of the masked regions 123. The thickness of the treatment applied may be substantially uniform throughout the warp and weft regions 122 or may vary. In some examples, the treatment may be thickest at the region proximal the opening 110 and decrease when moving toward the outer edge of the spider.

Figure 4:
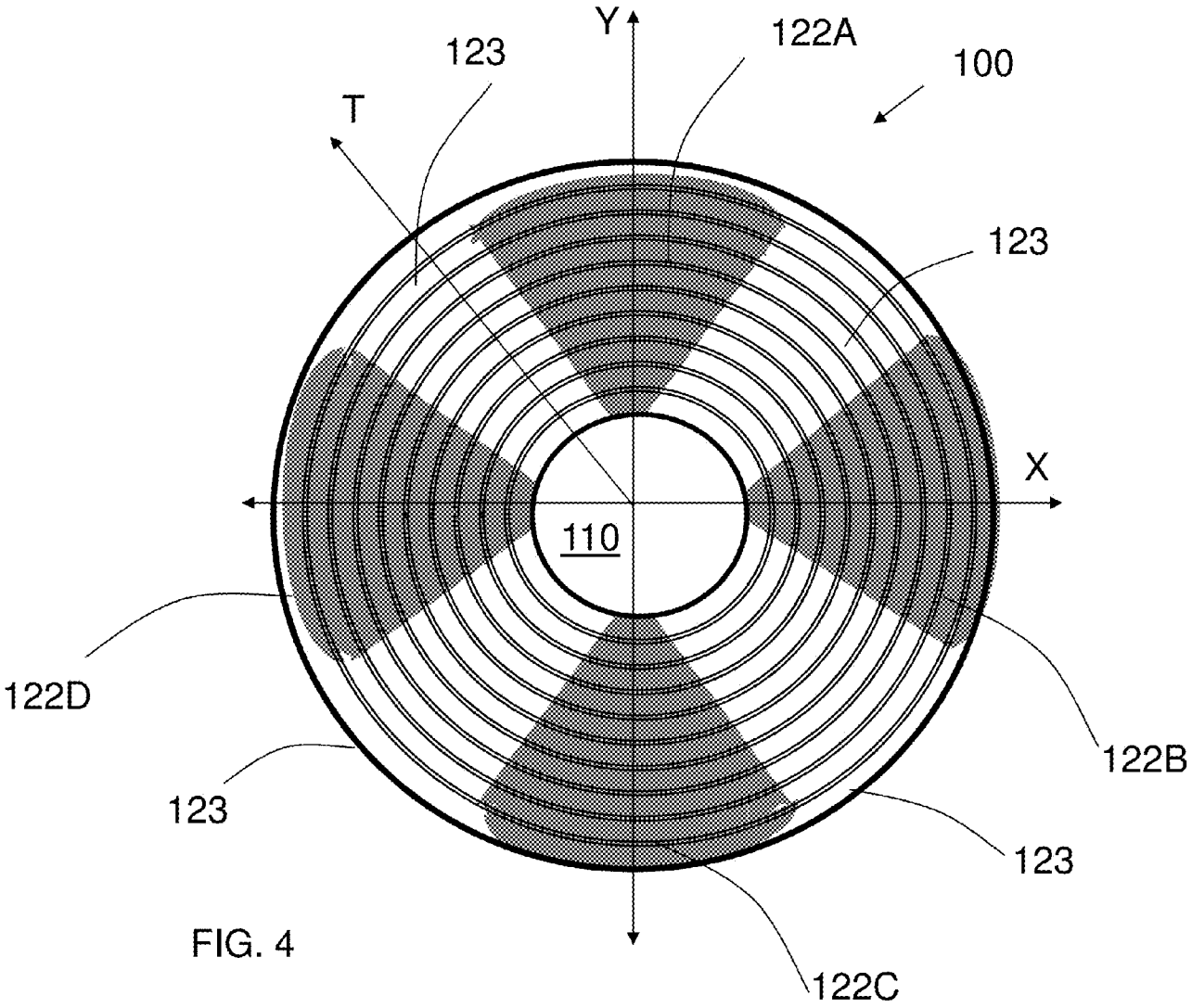
FIG. 4 illustrates an example of a front view of the suspension element of FIG. 2 after performing the process of FIG. 3.
Figure 5:
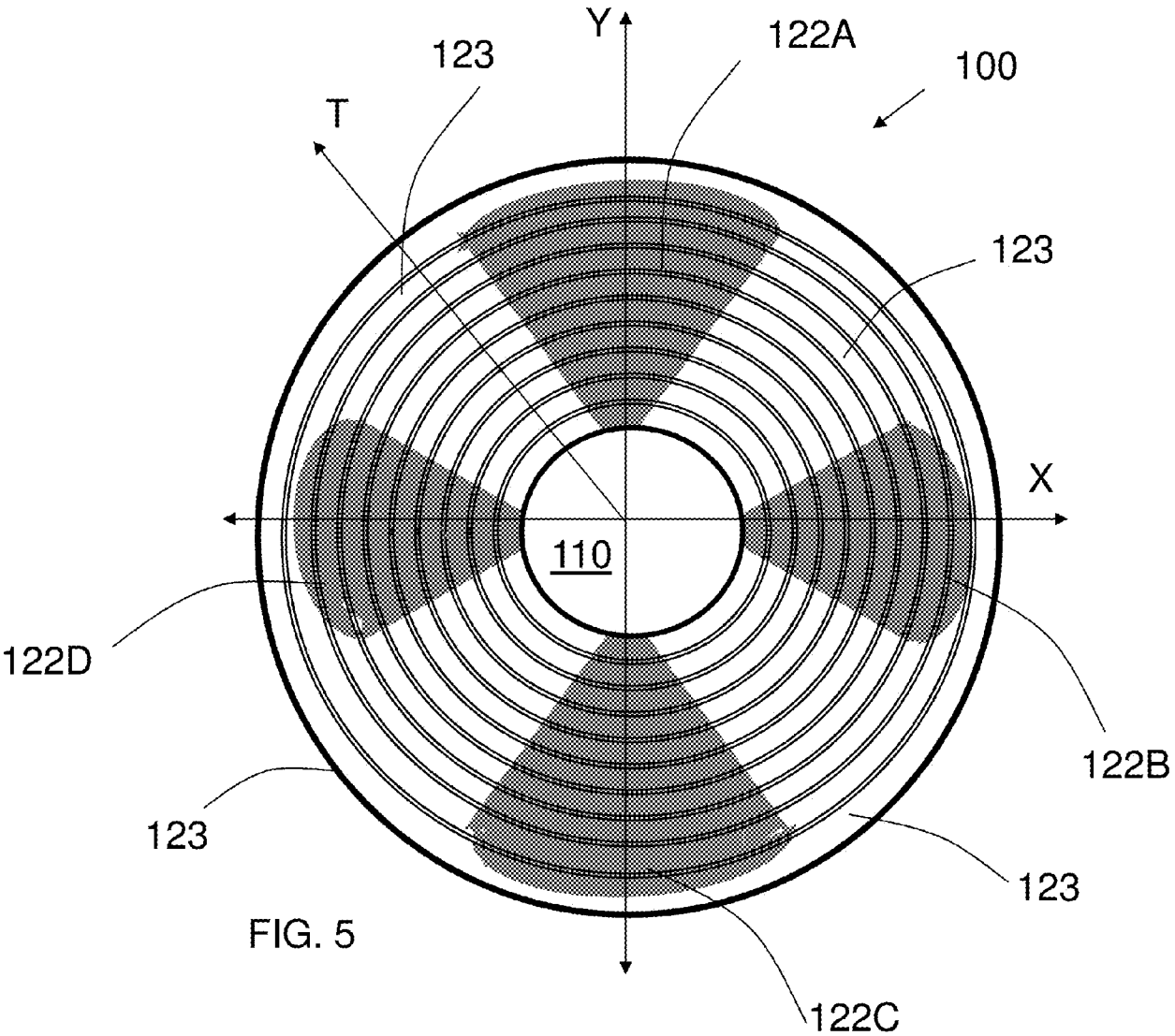
FIG. 5 illustrates another example of a front view of the suspension element of FIG. 2 after performing the process of FIG. 3.

As shown in FIG. 4, the treatment may be applied to the warp and weft regions 122A-122D to generally extend from the opening 110 to the outer edge of the spider 100. In other examples, the treatment may be applied to only a portion of the distance between the opening 110 and the outer edge of the spider 100. Moreover, a variety of shapes may be used for the warp and weft regions 122A-122D and the masked regions 123, some of which are shown in FIGS. 4 through 7. In the examples shown in FIGS. 4 and 5, the warp and weft regions 122 are generally pie-shaped with rounded edges. In the example in FIG. 4, the pie-shaped warp and weft regions 122 are the same or of a similar size. In the example shown in FIG. 5, the warp and weft regions 122A, 122C, respectively can be of a different size than the warp and weft regions 122B, 122D, respectively. In other examples, the shape could be generally a rectangle, square, ellipse, oval, lens, squoval, squircle, or any suitable shape. In some examples, the masked regions 123 can be generally rectangular in shape with rounded edges, but could be pie-shaped, a square, ellipse, oval, lens, squoval, squircle, or any suitable shape. The size and shape of the warp and weft regions 122 could be substantially the same as shown in FIG. 4, or they could have different sizes and shapes. For example, as shown in FIG. 5, the warp and weft regions 122A, 122C, respectively can be of a different size than the warp and weft regions 122B, 122D, respectively. In addition, the number of warp and weft regions 122A-122D and masked regions 123 could vary, though four of each are shown in FIGS. 4 through 7. In some examples, the treatment is applied in a manner that is symmetric about an axis. For example, as shown in FIG. 4, the overall pattern of the treatment may have an n-fold rotational symmetry, where n is an integer greater than 1 (e.g., $C_4$, tetrad, and so on). In other examples, as shown in FIG. 5, the overall pattern of the treatment may have a dihedral symmetry (e.g., $D_2$, $Dih_2$, and so on), and may be a rhombus, diamond or lozenge. Generally, the overall pattern of the treatment may have any shape that compensates for differences between the warp and weft regions and regions tangential to the warp and weft.

Figure 6:
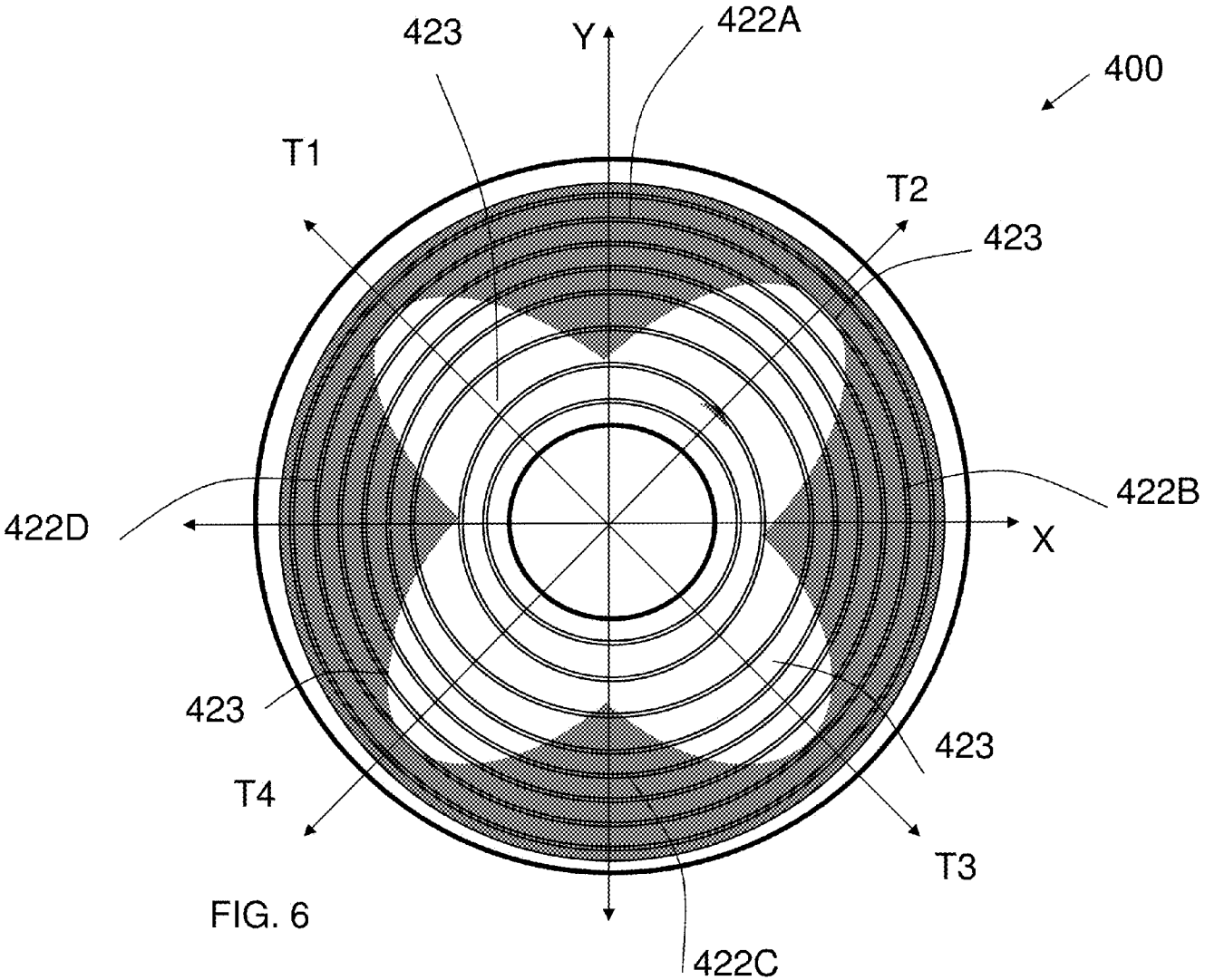
FIG. 6 illustrates another example of a front view of a suspension element.
Figure 7:
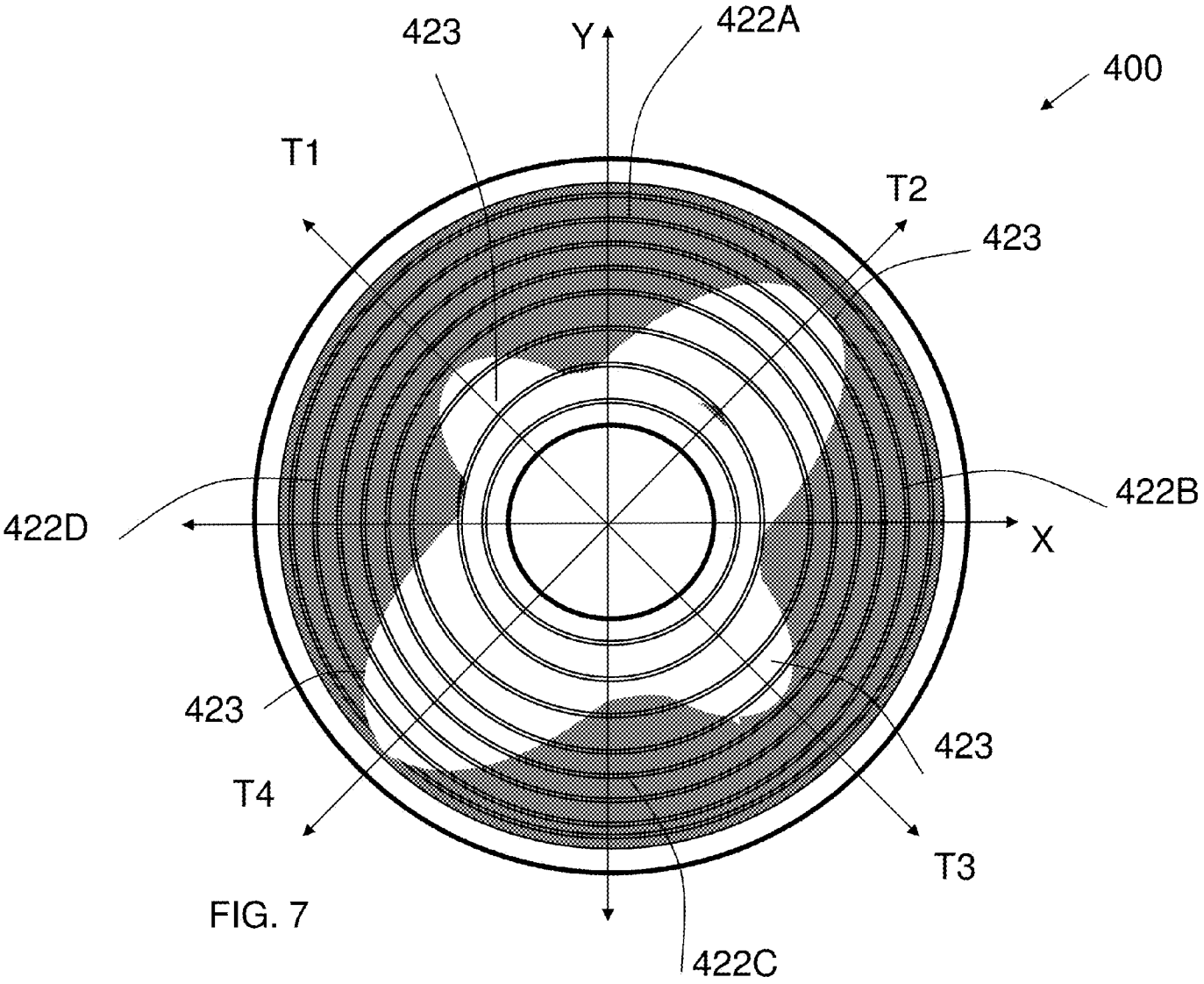
FIG. 7 illustrates another example of a front view of a suspension element.

FIGS. 6 and 7 illustrate other examples of a front view of a suspension element 400, with alternative treatment patterns to those shown in FIGS. 4 and 5. As in the examples of FIGS. 4 and 5, the suspension element of FIG. 6 has a treatment pattern generally having n-fold rotational symmetry, whereas the suspension element of FIG. 7 has a treatment pattern generally having dihedral symmetry. As shown in FIGS. 6 and 7, the suspension element can be a spider. In other examples, the process can be applied to a surround or related suspension elements.

As in the examples of FIGS. 4 and 5, the treatment may be applied (shown in gray) to regions of the spider 400 in a manner that compensates for differences in the warp and weft regions 422A-422D and/or regions 423 along bias directions T1-T4 between the X and Y directions, respectively, for example, about 45 degrees relative to the X and Y directions. One or more masks are constructed for permitting a selective treatment to be applied to the spider according to the configuration shown in FIGS. 6 and 7. Here, the treatment is applied to overcome deformation-related issues resulting from disparate forces or the like presented at the various regions of the spider 400. In FIGS. 6 and 7, the treatment does not extend to the ID 410 so that the region about the ID 410 is absent any treatment, which can aid with adhesion. Other benefits can include more consistent stress and strain from region to region, and improved overall stability. As shown in FIG. 6, the size and shape of the warp and weft regions could be substantially the same, or they could have different sizes and shapes, as shown in FIG. 7.

In some examples, varying amounts of treatment can be applied to the warp/weft regions 122 and masked regions 123, respectively, for equalizing stress concentrations or other desired effects. For example, the thickness of the treatment within the warp and weft regions 122 may vary, or the warp and weft regions 122 may receive different amounts of treatment. Moreover, regions 123 between the warp and weft regions 122 may receive treatment in an amount that differs from that applied to the warp and weft regions 122. Multiple treatment stages, for example, using one or more different masks geometries, can be applied.

The controller 230 may measure an elastic modulus or other measurements at the warp and weft regions 122 and compare the measurements to those at masked regions 123. The mask 210 can be adjusted so that a treatment quantity is applied according to the comparison result, so that treatment is applied until the stress at the warp and weft regions 122 is substantially the same as the stress at the masked regions 123, or within an acceptable threshold, for example, to reduce the effects of stiffness at the warp/weft regions to be comparable to that of non-warp/weft regions in view of an annular axisymmetric spider structure.

Figures 8A, 8B:
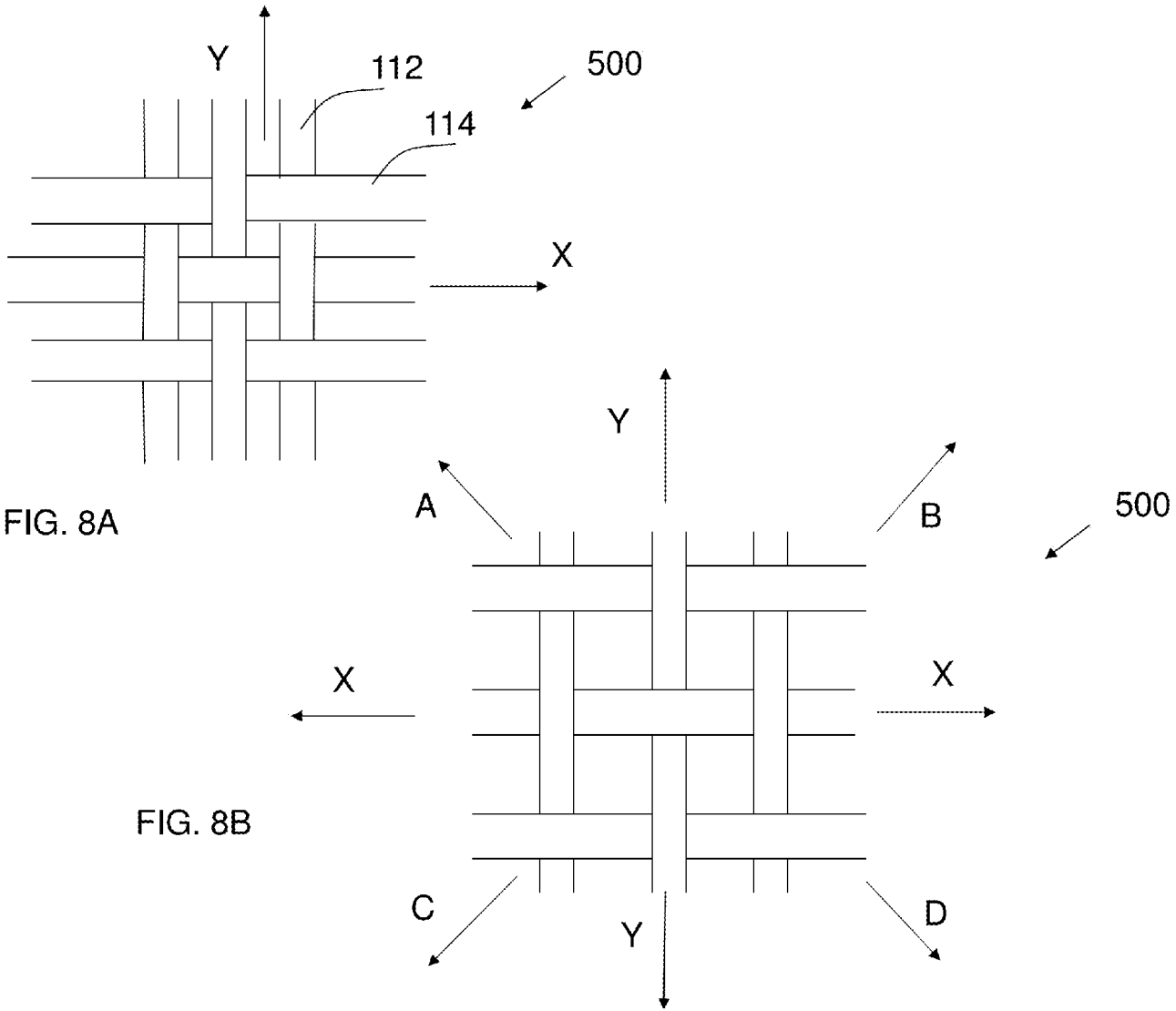
FIG. 8A is an enlarged view of a suspension element weave prior to an applied force.
FIG. 8B is an enlarged view of the suspension element weave of FIG. 8A in response to the application of a force.

FIG. 8A is an enlarged view of a suspension element weave 500 prior to an applied force, for example, a load. FIG. 8B is an enlarged view of the suspension element weave 500 of FIG. 8A in response to the application of a force. The suspension element weave 500 can be part of, but not limited to, the spider 100 described herein. Accordingly, the weave 500 can be a plain weave, a honeycomb weave, a triaxial weave, or a combination thereof, or other biaxial weave or arrangement of filaments, fibers, threads, or related elements. The warp fibers 112 and the weft wires 114 of the weave 500 cross in Y and X directions, respectively. The weave 500 expands and contracts as the spider 100 moves back and forth with the voice coil (not shown). Here, forces are applied to the weave fabric 500 in the X direction, Y direction, and tangential directions, for example, the T direction. Accordingly, stiffness, elastic deformation, and/or other material science characteristics known to those of ordinary skill in the art can vary at the regions along the X, Y, and T directions. The non-axisymmetric selective application of treatment or the like at the warp/weft regions 122 can reduce the stiffness at these regions relative to other regions 123 of the fabric, for example, a region 123 along the T direction, thereby changing the distribution of the modulus of elasticity and/or reducing the effects of axisymmetric stiffness or the like that may otherwise occur. Accordingly, the stress concentration or related forces can be reduced at the warp and weft regions, and the stress load at the spider is distributed in a more evenly manner as compared to an untreated weave.

Thus, during operation of a loudspeaker, the effects of the non-axisymmetric stiffness, for example, shape distortion, buckling, and so on, can be reduced.

Although the systems and methods described herein refer to a spider suspension element, the systems and methods herein are not limited thereto. For example, the systems and methods can relate to other suspension elements such as a surround or the like.

A number of implementations have been described. Nevertheless, it will be understood that the foregoing description is intended to illustrate and not to limit the scope which is defined by the claims.

What is claimed is:

1. A loudspeaker suspension, comprising:

a body formed of a weave fabric, the body having an outer region and a central region;

a warp region extending substantially from the central region to the outer region;

a weft region orthogonal to the warp region and extending substantially from the central region to the outer region; and a region between the warp region and the weft region, wherein at least a portion of the warp and weft regions of the weave fabric includes a stiffness-reducing treatment, so that the warp and weft regions have a greater amount of stiffness-reducing treatment than the region between the warp and weft regions.

2. The loudspeaker suspension of claim 1, wherein at least a portion of the region between the warp and weft regions includes the stiffness-reducing treatment, and wherein the warp and weft regions have a disproportionate application of the stiffness-reducing treatment as compared to the region between the warp and weft regions.

3. The loudspeaker suspension of claim 1, wherein the stiffness-reducing treatment reduces the effects of non-axisymmetric stiffness on the weave fabric of the body.

4. The loudspeaker suspension of claim 1, wherein the stiffness-reducing treatment substantially equalizes a stress concentration between the warp and weft regions and the region between the warp and weft regions when a load is applied to the body.

5. The loudspeaker suspension of claim 1, wherein the stiffness-reducing treatment is applied to the warp and weft regions so that the stiffness of the warp and weft regions is substantially the same as the stiffness of the region between the warp and weft regions.

6. The loudspeaker of claim 1, wherein the loudspeaker suspension comprises two warp regions and two weft regions, wherein the warp and weft regions are presented in alternation.

7. The loudspeaker of claim 6, wherein the two warp and two weft regions include the stiffness-reducing treatment, and the regions between the warp and weft regions do not include the stiffness-reducing treatment or include less stiffness-reducing treatment than the two warp and weft regions.

8. The loudspeaker suspension of claim 1, wherein the stiffness-reducing treatment comprises rubber.

9. The loudspeaker suspension of claim 1, wherein the portion of the warp and weft regions receiving the stiffness-reducing treatment are generally pie-shaped.

10. The loudspeaker suspension of claim 1, wherein the stiffness-reducing treatment extends substantially from the central region to the outer region of the body within the warp and weft regions.

11. The loudspeaker suspension of claim 1, wherein the thickness of the stiffness-reducing treatment varies across the warp and weft regions.

12. The loudspeaker suspension of claim 1, wherein a region applied with the stiffness-reducing treatment includes a four-fold rotational symmetry shape.

13. The loudspeaker suspension of claim 1, wherein a region applied with the stiffness-reducing treatment includes a dihedral symmetry shape.

14. The loudspeaker suspension of claim 1, further comprising an opening at the central region of the body for receiving a voice coil.

15. The loudspeaker suspension of claim 1, where the central region includes at least a portion of the weave fabric, and wherein a voice coil is coupled to the portion of the weave fabric at the central region.

16. An electroacoustic transducer, comprising:

a basket;

a voice coil; and a suspension element having an outer region coupled to the basket, and an inner region coupled to the voice coil;

the suspension element having a warp region, a weft region orthogonal to the warp region, and a region between the warp region and the weft region, at least a portion of the warp and weft regions having a stiffness-reducing treatment, such that the warp and weft regions have a stiffness that is substantially the same as a stiffness of the region between the warp and weft regions and such that the warp and weft regions have a greater amount of stiffness-reducing treatment than the region between the warp and weft regions.

17. The electroacoustic transducer of claim 16, wherein the suspension element is a spider.

18. The electroacoustic transducer of claim 16, wherein the suspension element is a surround.

19. The electroacoustic transducer of claim 16, wherein at least a portion of the region between the warp and weft regions includes the stiffness-reducing treatment, and wherein the warp and weft regions have a disproportionate application of the stiffness-reducing treatment as compared to the at least one region between the warp and weft regions.

20. The electroacoustic transducer of claim 16, wherein the stiffness-reducing treatment reduces the effects of non-axisymmetric stiffness on the suspension element.

21. The electroacoustic transducer of claim 16, wherein the stiffness-reducing treatment substantially equalizes a stress concentration between the warp and weft regions and the at least one region between the warp and weft regions when a load is applied to the suspension element.

22. The electroacoustic transducer of claim 16, wherein the stiffness-reducing treatment is applied to the warp and weft regions so that the stiffness of the warp and weft regions is substantially the same as the stiffness of the at least one region between the warp and weft regions.

23. The electroacoustic transducer of claim 16, wherein the stiffness-reducing treatment comprises rubber.

24. The electroacoustic transducer of claim 16, wherein the portion of the warp and weft regions receiving the stiffness-reducing treatment are generally pie-shaped.

25. The electroacoustic transducer of claim 16, wherein the stiffness-reducing treatment extends substantially from the inner region to the outer region of the suspension element within the warp and weft regions.

26. The electroacoustic transducer of claim 16, wherein the thickness of the stiffness-reducing treatment varies across the warp and weft regions.

27. The electroacoustic transducer of claim 16, wherein a region applied with the stiffness-reducing treatment includes a four-fold rotational symmetry shape.

28. The electroacoustic transducer of claim 16, wherein a region applied with the stiffness-reducing treatment includes a dihedral symmetry shape.

29. A method for forming a suspension element for an acoustic driver, comprising:

forming a body of a weave fabric, the body having an outer region and a central region;

selectively applying a stiffness-reducing treatment to at least one of a warp region and a weft region orthogonal to the warp region;

comparing a stress at the at least one warp and weft region and a stress at a region between the warp and weft regions; and adjusting an amount of the stiffness-reducing treatment applied to the at least one warp and weft region until the stresses at the at least one warp and weft region and the region between the warp and weft regions, respectively, are substantially the same or within a predetermined threshold relative to each other.

30. The method of claim 29, wherein prior to the application of the stiffness-reducing treatment, impregnating the weave fabric with a resin.

31. The method of claim 30, further comprising:

positioning a mask over the body, the mask including openings aligned with, and exposing, the at least one warp and weft region to be applied with the stiffness-reducing treatment.

32. The method of claim 31, further comprising:

selectively applying the stiffness-reducing treatment to at least one region between the warp and weft regions, and wherein the mask includes multiple masks, which are positioned over the body to apply different amounts of the stiffness-reducing treatment to the warp and weft regions and the at least one region between the warp and weft regions, respectively.

33. The method of claim 29, wherein at least a portion of a region between the warp and weft regions includes the stiffness-reducing treatment, and wherein the at least one warp and weft region has a disproportionate application of the stiffness-reducing treatment as compared to the region between the warp and weft regions.

34. The method of claim 29, further comprising reducing the effects of non-axisymmetric stiffness on the weave fabric of the body in response to a selective application of the stiffness-reducing treatment on the body.

35. The method of claim 29, wherein the stiffness-reducing treatment substantially equalizes a stress concentration between the at least one warp and weft region and at least one region between the warp and weft regions when a load is applied to the body.

36. The method of claim 29, wherein the stiffness-reducing treatment is applied to the at least one warp and weft region so that the stiffness of the at least one warp and weft region is substantially the same as the stiffness of at least one region between the warp and weft regions.

37. The method of claim 29, wherein the thickness of the stiffness-reducing treatment varies across the at least one warp and weft region.

38. A method for forming a suspension element for an acoustic driver, comprising:

forming a body of a weave fabric, the body having an outer region and a central region; and selectively applying a stiffness-reducing treatment to at least one of a warp region and a weft region orthogonal to the warp region, wherein at least a portion of a region between the warp and weft regions includes the stiffness-reducing treatment, and wherein the at least one warp and weft region has a disproportionate application of the stiffness-reducing treatment as compared to the region between the warp and weft regions.

* * * * *